US005175041A

United States Patent [19]

Webb et al.

[11] Patent Number: 5,175,041

[45] Date of Patent: Dec. 29, 1992

[54] CORNER AND EDGE PROTECTOR FOR PACKAGING

[75] Inventors: H. Richard Webb; John F. Moog; Buford R. Strauser; Wayne S. Pratt, all of St. Louis, Mo.

[73] Assignee: Innovative Enterprises, Inc., St. Louis, Mo.

[21] Appl. No.: 646,432

[22] Filed: Jan. 28, 1991

[51] Int. Cl.[5] ..... B32B 3/12

[52] U.S. Cl. ..... 428/116; 206/586; 229/DIG. 1; 428/542.8

[58] Field of Search ..... 248/345.1; 206/586; 229/DIG. 1; 428/73, 116, 117, 118, 542.8

[56] References Cited

U.S. PATENT DOCUMENTS

| | | | |
|---|---|---|---|
| 3,361,322 | 1/1968 | Gabriel et al. | 206/586 X |
| 3,428,424 | 2/1969 | Keith | 428/116 X |
| 3,655,112 | 4/1972 | Jeffers | 206/586 |
| 3,900,156 | 8/1975 | Clark, Jr. | 248/345.1 X |
| 3,955,677 | 5/1976 | Collingwood | 229/DIG. 1 |
| 4,287,265 | 9/1981 | McKnight | 428/218 X |
| 4,319,530 | 3/1982 | Moog | 108/51.3 |
| 4,790,249 | 12/1988 | Webb | 108/51.3 |
| 4,883,179 | 11/1989 | Dionne | 229/DIG. 1 |
| 4,972,954 | 11/1990 | Dickie | 206/586 X |

*Primary Examiner*—Henry F. Epstein
*Attorney, Agent, or Firm*—Polster, Lieder, Woodruff & Lucchesi

[57] ABSTRACT

A corner protector, which is formed entirely from paper honeycomb material, fits between the corner of a container and the corner of a relatively rigid object in the container and thereby positions the object within the container and protects it from impacts to which the container may be subjected. The corner protector, when in its assembled configuration, has at least three panels which are arranged perpendicular to each other. Being formed from paper honeycomb material, each panel has inner and outer facer sheets and honeycomb cells interposed between the facer sheets, with the axes of the cells being perpedicular to the facer sheets. The three panels share a common outer facer sheet, with the first and third panels being joined to the second panel along fold lines in that facer sheet. However, the inner facer sheets of the three panels are clearly distinguishable by reason of slit lines that separate them. Moreover, in the region of the slit lines the honeycomb cells are crushed such that the inner facer sheets are beveled downwardly to the fold lines. The panels abut along the beveled surfaces of their inner facer sheets. An edge protector has at least two panels which are joined through a common outer facer sheet and are beveled at their inner facer sheets opposite a fold line in the common outer facer sheet. This permits the protector to be folded over an edge of the object with the inner facer sheets presented inwardly toward the object.

26 Claims, 5 Drawing Sheets

FIG. 3.
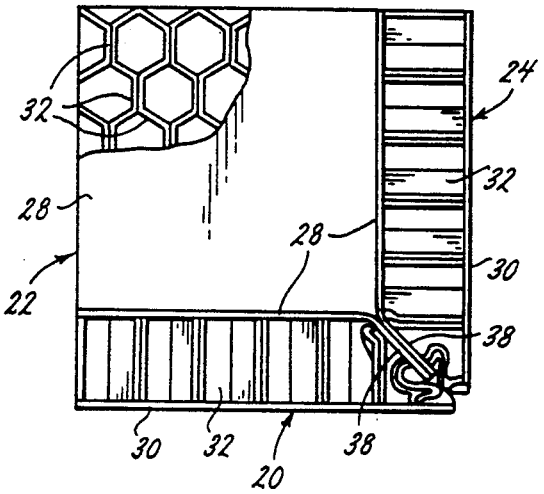
FIG. 4.
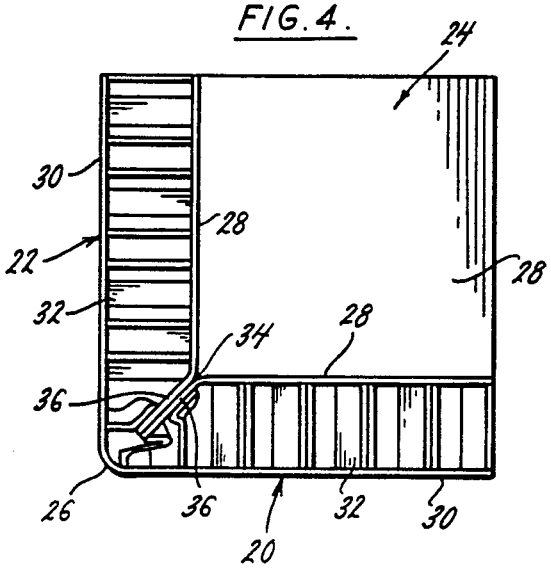
FIG. 5.
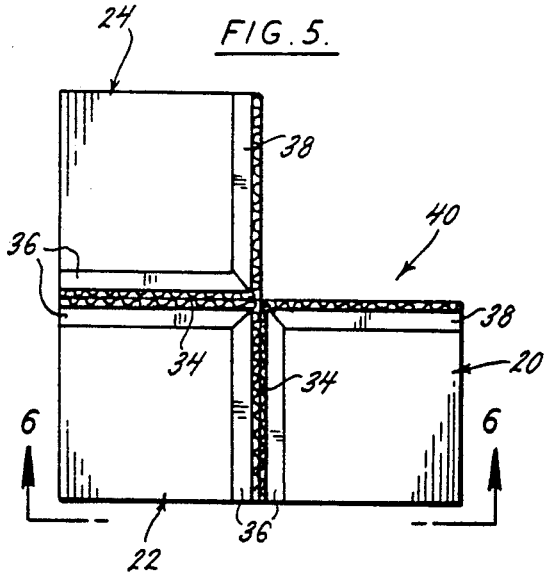
FIG. 7.
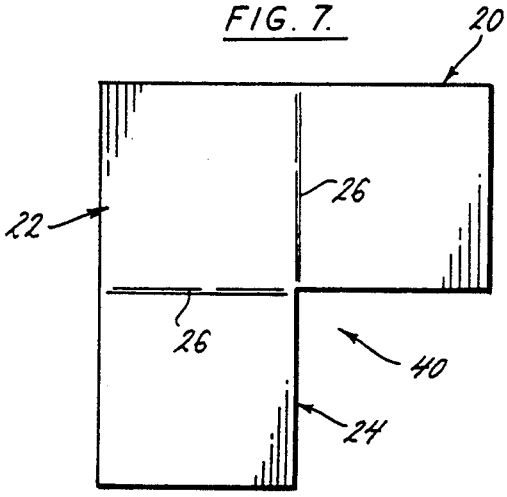
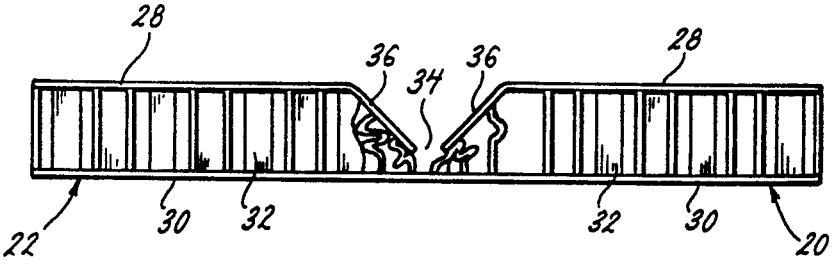
FIG. 6.

FIG. 13.
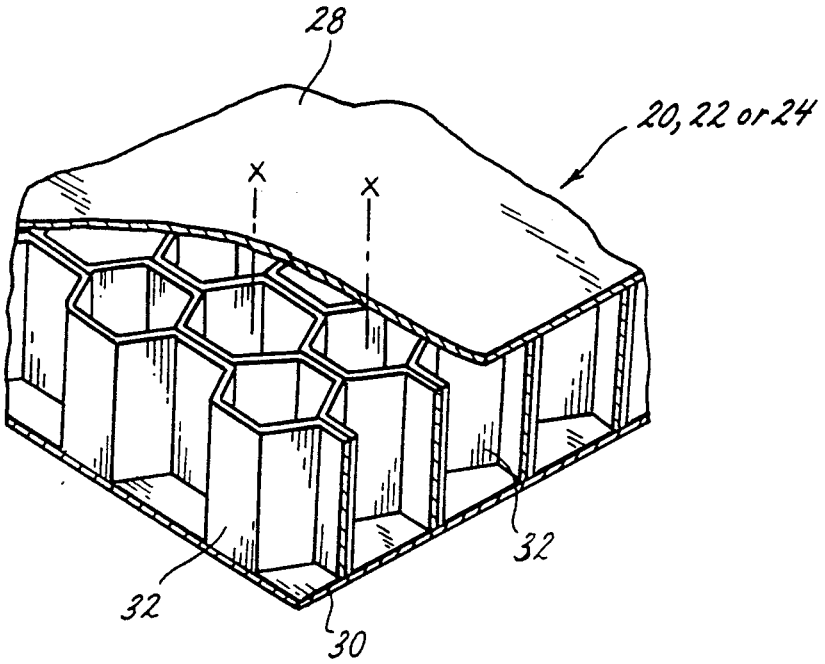
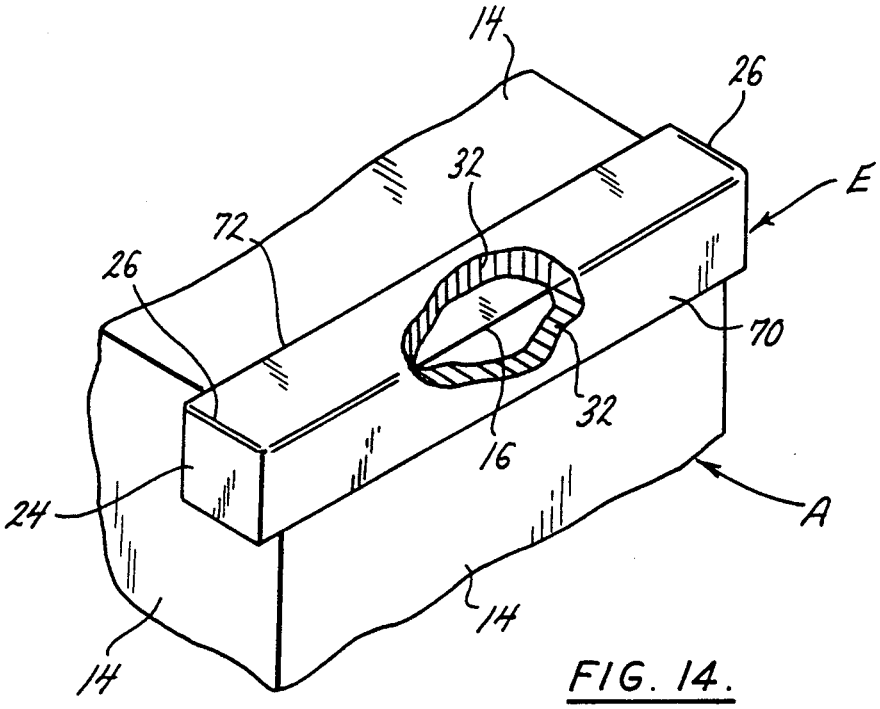
FIG. 14.

CORNER AND EDGE PROTECTOR FOR PACKAGING

BACKGROUND OF THE INVENTION

This invention relates in general to packaging and more particularly to protectors for positioning objects in containers with an added measure of protection.

Many manufactured goods, particularly appliances and electronic equipment, possess box-like configurations and often have attractive finishes on their exterior surfaces. In order to protect these goods during transit and storage, manufacturers customarily pack them in boxes made from corrugated paperboard. By fitting corner protectors to an object of this character, a manufacturer can derive an extra measure of protection, for corner protectors create spaces between the exterior surfaces of the object and the walls of the box, so that a slight deformation or penetration of any box wall will not damage the packaged object. Indeed, shipping regulations often require such air spaces. Moreover, to a measure, the corner protectors suspend the object within the box and greatly help to absorb impacts that might otherwise be transferred from the box to the object with full force. Edge protectors serve the same function, but are more extensive in that they extend along an edge, sometimes from one corner to the opposite corner along that edge.

The typical corner or edge protector currently used in packaging rigid box-like objects in boxes is molded from an expanded polymer such as polystyrene. Once the packaging has served its purpose, these protectors are simply discarded along with the corrugated paperboard box. But the polymers from which the corner or edge protectors are molded do not degrade in landfills and may not be accepted for disposal at landfills. While most of the polymers lend themselves to recycling, that is to conversion into new plastic products, the conversion is not easily achieved. Aside from that, polymer foams tend to fracture and crumble when subjected to impacts, and when used for corner or edge protectors, will leave a residue of loose particles in the package.

Some corner and edge protectors are formed from built-up layers of corrugated paperboard, but these protectors require excessive layers of paperboard to achieve the desired thickness and usually require assembly by the packager. Furthermore, the layers of paperboard tend to collapse and thus transfer impacts that should be absorbed.

The present invention resides in a corner protector and an edge protector having their panels formed from honeycomb material, particularly paper honeycomb material. They absorb impacts well, easily degrade in landfills, will not easily fracture in the presence of impacts, are economical to manufacture, and the materials from which they are manufactured may be recycled.

DESCRIPTION OF THE DRAWINGS

In the accompanying drawings which form part of the specification and wherein like numerals and letters refer to like parts wherever they occur:

FIG. 3 is a sectional view taken along line 3—3 of FIG. 2 and showing one of the facer sheets broken away to expose the honeycomb cells;

FIG. 4 is a sectional view taken along line 4—4 of FIG. 2;

FIG. 5 is a plan view of the inside face of a blank, which when folded produces the corner protector;

FIG. 6 is an end view of the blank taken along line 6—6 of FIG. 5;

FIG. 7 is a plan view of the outside face of the blank;

FIG. 13 is a perspective view partially broken away and in section of one of the panels in the corner protector; and FIG. 14 is a perspective view, partially broken away, of an edge protector fitted to the edge of a box-like object.

DETAILED DESCRIPTION

Figure 1:
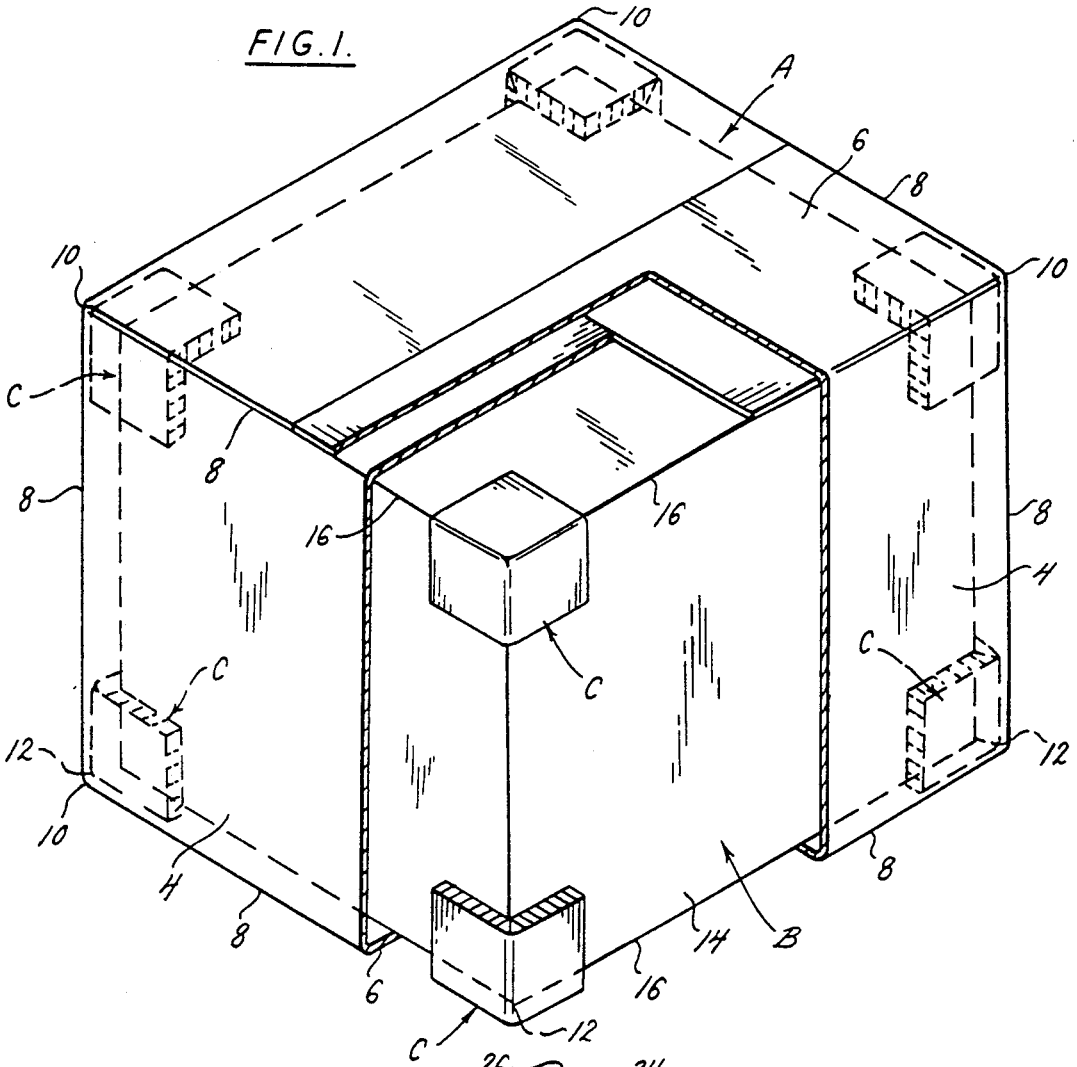
FIG. 1 is a perspective view showing a box-like object fitted into a container and isolated from the walls of the container with corner protectors constructed in accordance with and embodying the present invention.

Referring now to the drawings, a container A (FIG. 1) holds a generally rigid object B, with the object B being positioned within the container A—and in effect suspended—by corner protectors C. In other words, the corner protectors C to a large measure separate and isolate the object B from the walls of the container A. As a consequence, the corner protectors C provide an extra measure of protection for the object B, preventing it from sustaining damage which might otherwise occur when the container A experiences impacts of sufficient magnitude to deform it or perhaps even cause a slight penetration.

Typically, the container A is nothing more than a conventional six-sided box formed from corrugated paperboard. It has four side walls 4 (FIG. 1) which fold to form a tube and flaps which fold over onto one another to provide end walls 6. The side and end walls 4 and 6 meet at edges 8 which intersect at eight corners 10, with each corner 10 representing the convergence of three edges 8. The rigid object B conforms generally to the interior of the container A, at least in the sense that it fits within the container A and has a like number of outside corners 12 set inwardly from the corners 10 of the inside container A. Typically, the object B has six walls 14 which meet at edges 16, and the edges 16 in turn converge to the corners 12, there being three edges 16 leading to each corner 10. Four of the walls 14 of the object B lie slightly inwardly from the side walls 4 of the container A, while the other two are set slightly inwardly from the end walls 6. The corner protectors C, which fit over the corners 12 of the rigid object B and into the corners 10 of the container A, position the object B within the container A and maintain a separation between the walls 14 of the object B and the walls 4 and 6 of the container A.

The eight corner protectors C may be identical. Each includes (FIGS. 2–4) three flat panels 20, 22 and 24 which may be rectangular in shape and are arranged perpendicular to each other, at least when the corner protector C is in its operative configuration. The panels 20, 22 and 24 are joined together at fold lines 26, with the panel 22 being, in effect, interposed between the panels 20 and 24. Thus, the fold lines 26 form two converging or adjacent edges of the middle panel 22, but each of the end panels 20 and 24 has a fold line 26 along only one of its edges. When the corner protector C is fitted within a corner 10 of the container A and over the corresponding corner 12 of the rigid object B, it conforms to these corners 10 and 12 in the sense that its panels 20, 22 and 24 lie perpendicular to each other and fill the spaces between the walls 14 of the object B and the opposing walls 4 and 6 of the container A in the region of the corner 10 for the container A. Indeed, the panels 20, 22 and 24 are essentially as thick as the spaces between the walls 14 of the object B, on one hand, and the walls 4 and 6 of the container A, on the other.

Each panel 20, 22 and 24 consists of (FIG. 13) an inner facer sheet 28 and an outer facer sheet 30 and honeycomb cells 32 interposed between the facer sheets 28 and 30, with the axes x of the cells 32 being perpendicular to the sheets 28 and 30. Both the facer sheets 28 and 30 and cells 32 are formed from paper, such as kraft paper. The cells 32 have individual walls of paper arranged in a hexagonal configuration and are derived by simply gluing sheets of paper together along alternating spaced lines of glue and then expanding the pack, thus forming a honeycomb configuration. The ends of the cells 32 are glued to opposing faces of the facer sheets 28 and 30. The honeycomb cells 32 impart considerable strength to the panels 20, 22 and 24 and make them extremely difficult to crush, all while keeping the weight of the corner protectors C almost negligible. Paper honeycomb material from which the panels of the corner protector C may be formed is available as a common article of commerce.

Figure 2:
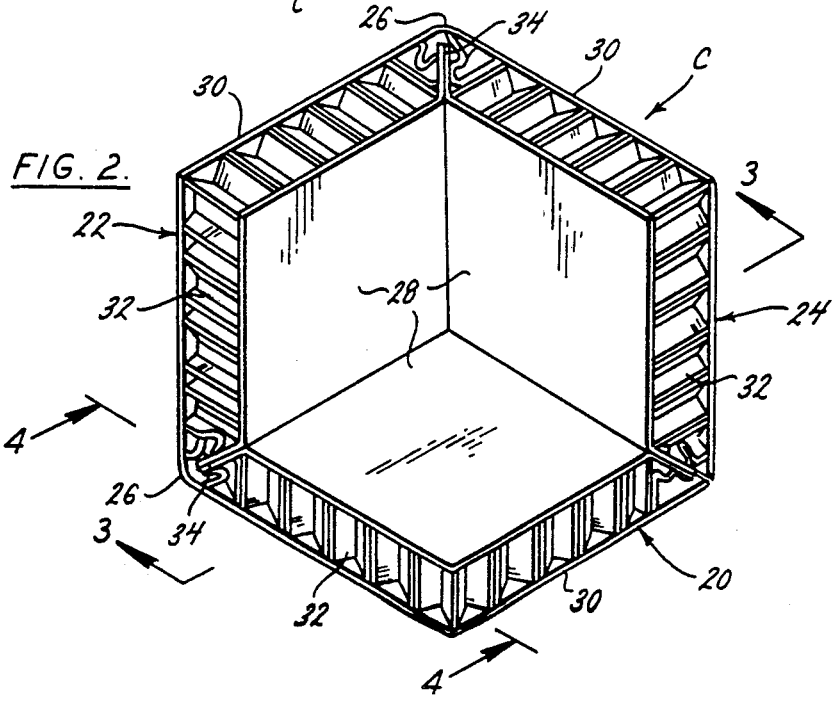
FIG. 2 is a perspective view of one of the corner protectors in its operative configuration.
Figure 8:
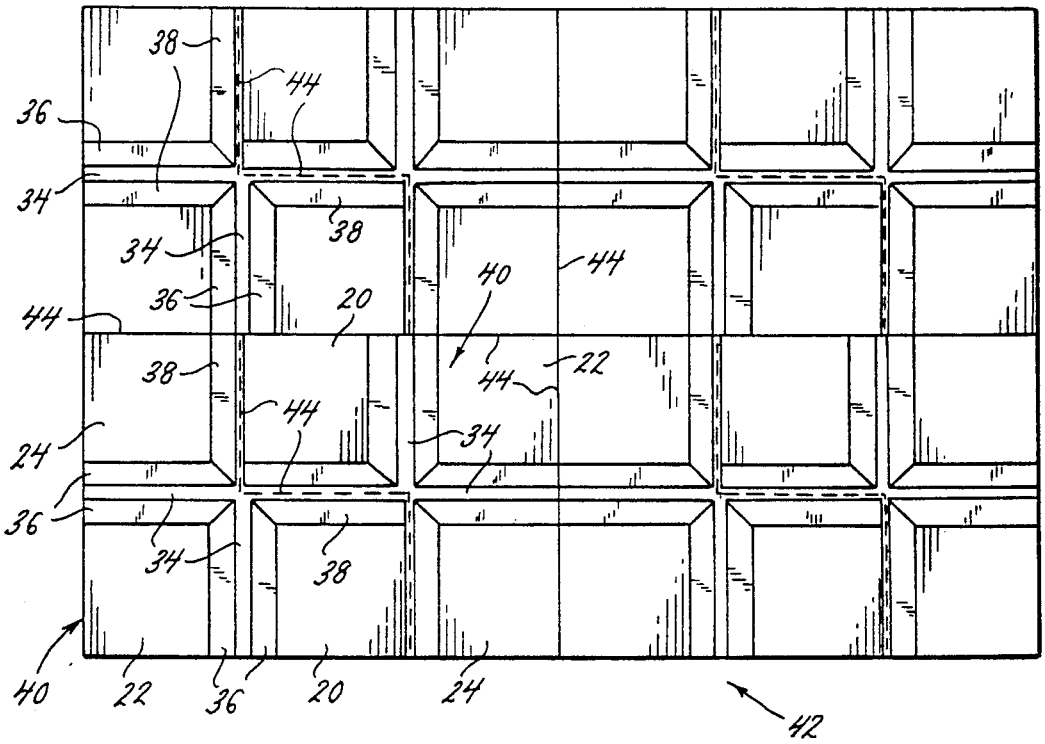
FIG. 8 is a plan view of the inside face of a sheet of honeycomb material containing numerous blanks.
Figure 9:
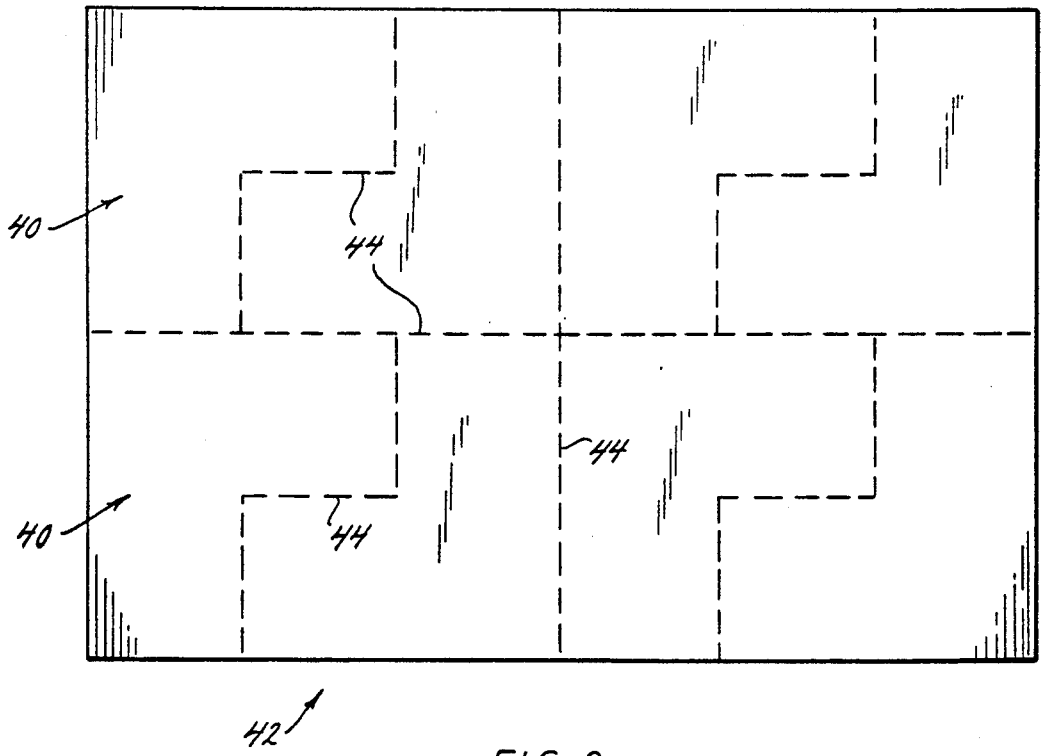
FIG. 9 is a plan view of the outside face of the sheet.

The three panels 20, 22 and 24 are united along their outer facer sheets 30 such that the three panels 20, 22 and 24 share a common outer facer sheet 30. Indeed, it is within this common outer facer sheet 30 that the two fold lines 26 exist. However, the honeycomb cells 32 and the inner facer sheets 28 are severed along slit lines 34 (FIGS. 4 and 6) that lie parallel to the fold lines 26 so as create the three distinct panels 20, 22 and 24. Along both sides of each slit line 34 the honeycomb cells 32 are crushed to present the inner facer sheets 28 of the panels 20, 22 and 24 in these regions at about 45° with respect to the outer facer sheets 28, or in other words in these regions the panels 20, 22 and 24 are provided with beveled surfaces 36. The honeycomb cells 32 of the panels 20 and 24 are also crushed along the edges that lead away from the intersection of the two fold lines 26 to provide additional beveled surfaces 38 (FIG. 3) in the inner facer sheets 28. The surfaces 38 are inclined downwardly toward the detached edges, along which they lie, again at about 45°. The beveled surfaces 36 of the panels 20, 22 and 24 abut along the fold lines 26, whereas the beveled surfaces 38 abut along the detached edges that lead away from the fold lines 26 (FIGS. 2–4). With the two sets of beveled surfaces 36 and 3 abutting, the corner protector C assumes its three-sided operative configuration, in which its panels 20, 22 and 24 are oriented perpendicular to each other.

Unless confined or restrained, the corner protector C will revert to an open configuration in which its three panels 20, 22 and 24 lie in essentially the same plane. It is in this configuration that the corner protector C is supplied; that is to say, it is supplied as a flat blank 40 (FIGS. 5–9). The capture of the corner protector C between the walls 4 and 6 at the corner 10 of the container A and the walls 14 at the corner 12 of the rigid object B provides the confinement necessary to hold the corner protector A in its three-sided operative condition. In lieu of confinement, an adhesive, applied to the beveled surfaces 38 that lie along the slit lines 34, may be used to hold the corner protector C in its operative configuration. Preferably the adhesive is of the contact variety and is applied to the beveled surfaces 38 of the blank 40 before the blank 40 (FIG. 8) is folded along the fold lines 26 into the three-sided configuration. A bonding agent known as a cohesive adhesive is ideally suited for this purpose.

The corner protectors C are shipped to the user in their open condition, that is, as blanks 40 (FIG. 8), for in this flat condition they occupy less space. Actually, several blanks 40 are joined together in cut and formed honeycomb sheets 42 (FIGS. 8 and 9), and the blanks 40 are simply detached from each other when needed and then folded into the operative configuration in which their panels 20, 22 and 24 are oriented perpendicular to each other. Each honeycomb sheet 42 is rectangular and contains several open corner blanks 40 joined together at notched cuts. The beveled surfaces 36 and 38 of the several blanks 40 in the sheet 42 may have the contact adhesive already applied to them.

To form the blanks 40, a sheet of paper honeycomb having the thickness desired for the panels 20, 22 and 24 of the corner protectors C is placed on a plate toward which a die moves. The die has serrated knife blades projecting from it, and these blades follow the open outline of the individual corner protectors C. The die cuts through the inside facer sheet 28, the honeycomb cells 32, and the outside facer sheet 30, producing interrupted separating cuts 44 (FIG. 9) in the honeycomb sheet 42. The intermittent connections existing in the cuts 44 serve to hold the individual blanks 40 together within the sheet 42. The die has additional blades which produce the slit lines 34 in the inside facer sheet 28 of the blank 40. These blades are continuous and produce full cuts. Furthermore, they are deep enough to cut through the underlying honeycomb cells 32, but stop short of the outside facer sheet 30. Finally, the die is provided with wedge-shaped crushing sections along the blades which form the slit lines 34 and also along some of the blades which form the full separating cuts 44. As the die approaches the plate, these wedges bear against the inside facer sheet 28 and crush the underlying honeycomb cells 32. In so doing, they impart the beveled surfaces 36 and 38 to the blanks 40.

To protect the object B within the container A, the container A while in a tubular configuration, that is with the flaps that form its end walls 6 open, is passed over the rigid object B. Individual blanks 40 are detached from the sheet 42 simply by pulling the blanks 40 apart at the notched separating cuts 44. Four blanks 40 are then folded into the operative configuration to provide three-sided corner protectors C, and those corner protectors C are inserted into the one end of the container A such that they fit around the four corners 12 of the object B that are at that end of the container A. The end flaps at that end are then folded over the corner protectors C to form an end wall 6 which together with the side walls 4 confine the corner protectors C and hold them in their operative configuration. Next the container A with the object B within it is inverted and four more corner protectors C are inserted into its opposite end where they are fitted over the four remaining corners 12 of the object B. The flaps at that end of the container C are folded over to complete the other end wall 6. This end wall 6 together with the side walls 4 confine the second set of four corner protectors C and prevent them from opening.

The corner protectors C space the object B from the side walls 4 and end walls 6 of the container A and thus position the object B in the container A and isolate it from impacts that might deform or even puncture the side and end walls 4 and 6 of the container A. Moreover, they partially absorb impacts, so that an impact received at one of the corners 10 of the container A is not transferred with full force to the object B, and they do this without crumbling in the presence of the impacts. Aside from that, the corner protectors C are easy to manufacture and utilize inexpensive honeycomb material. As a consequence, they are produced at relatively low cost. Finally, being formed from essentially kraft paper, the corner protectors C lend themselves to recycling, in that once they have served their purpose, they are easily converted to paper pulp. Even if the corner protectors C, after being discarded, find their way to a landfill, they will break down within the landfill.

Figure 10:
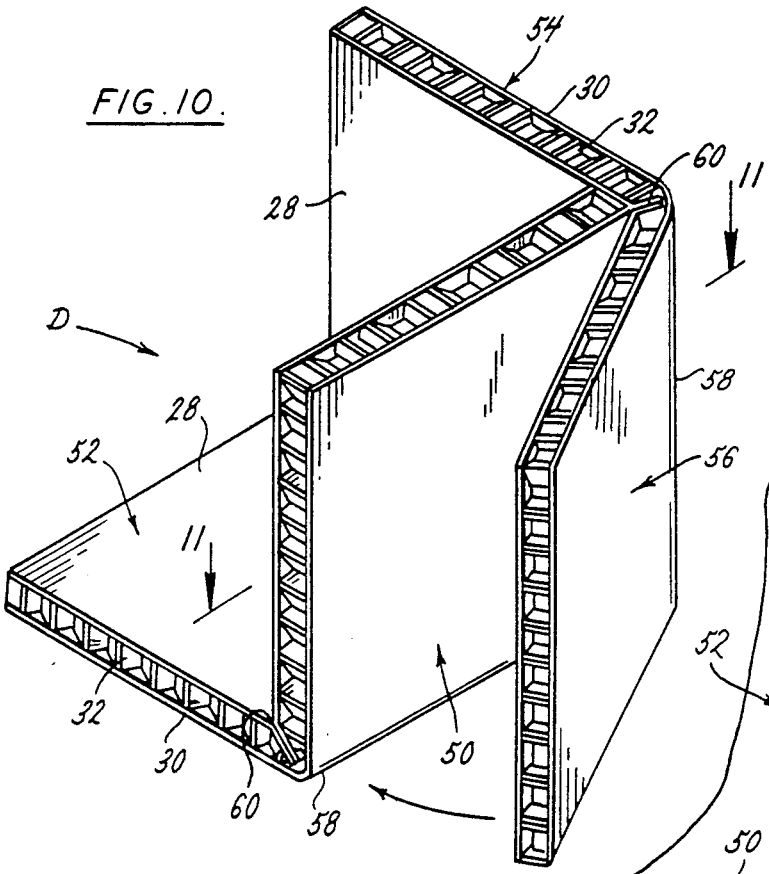
FIG. 10 is a perspective view of a modified corner protector.
Figure 12:
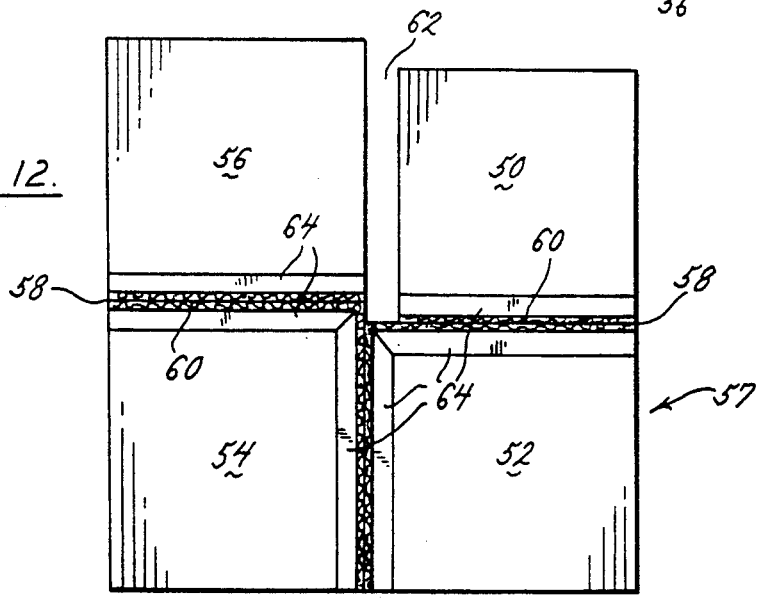
FIG. 12 is a plan view of the inside face of a blank for the modified corner protector.

A modified corner protector D (FIG. 10) contains four panels 50, 52, 54 and 56, instead of three, and each, when in the open condition of a blank 57 (FIG. 12), assumes a generally rectangular shape instead of an L-shaped configuration. Like the corner protector C, the corner protector D is formed from honeycomb material composed of spaced apart inner and outer facer sheets 28 and 30 and paper honeycomb cells 32 interposed between the facer sheets 28 and 30, with the axes x of the cells 32 being perpendicular to the sheets 28 and 30 (FIG. 13).

The four panels 50, 52, 54 and 56 are rectangular in configuration and are connected to each other at fold lines 58 which exist within the outer facer sheets 30. In this regard, the outside facer sheets 30 of the four panels 50, 52, 54 and 56 are united and hence continuous, and the panels 50, 52, 54, and 56 are distinguishable along their outside facer sheets 30 only by the fold lines 58. However, the facer sheets 28 of the panels 50, 52, 54, and 56 are separated by slit lines 60 which lie parallel to and along the fold lines 58 and extend into the underlying honeycomb cells 32.

More specifically, the panel 50 is connected to the panel 52 along one fold line 58, while the panel 54 is connected to the panel 52 along another fold line 58 that lies at a right angle to the first fold line 58. The panel 56, on the other hand, is connected to the panel 54 along still another fold line 58 which extends parallel to the fold line 58 between the panels 50 and 52, but is offset slightly from that fold line, indeed, by a distance which equals the thickness of the honeycomb material. The panel 56 lies adjacent to the panel 50, but is detached from the panel 50. When the protector D is open as the blank 57 (FIG. 12), the two panels 50 and 56 are separated by a space 62 that is as wide as the honeycomb material is thick. Finally, along each of the slit lines 60, the honeycomb cells 32 are crushed to impart beveled surfaces 64 to the facer sheets 28 of the panels 50, 52, 54 and 56, there being beveled surfaces 64 along both sides of each slit line 60.

Figure 11:
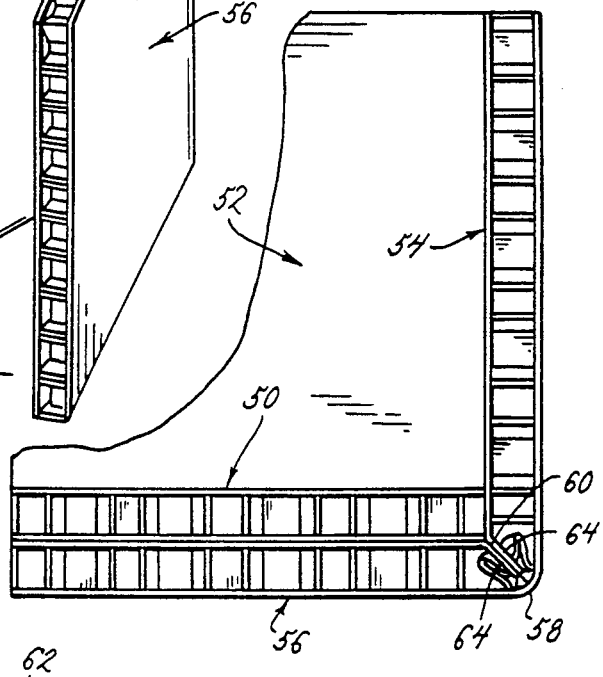
FIG. 11 is a sectional view of the modified corner protector taken along line 11—11 of FIG. 10.

The panels 50, 52 and 54 are folded perpendicular to each other along the fold lines 58 that separate them and of course the beveled surfaces 64 of those adjacent panels bear against each other. Moreover, the bottom edge of the panel 56 (FIG. 12) lies along the top edge of the panel 54 where it has a slit 60 that separates the panels 54 and 56, and that slit 60 runs parallel with the slit 60 between the panels 50 and 52, but is stepped up a distance equal to the thickness of the honeycomb material. This provides enough clearance for the panel 56, which is folded behind the panel 50, so that the two panels 50 and 56 abut (FIG. 11). The panels 50 and 56 on their outer and inner facer sheets 30 and 28, respectively, may be provided with a contact adhesive to hold the panels 50 and 56 together, and this of course holds the entire protector D in its operative configuration. On occasion there may be a need to crush the panels 50 and 56 to provide dimensions other than a double thickness, or for that matter the other panels 52 and 54 may be crushed as well.

The double thickness formed by the overlying panels 50 and 56 provides an extra measure of protection along one of the walls 14 of the object B. It further creates a deeper space between that wall 14 of the object B and the opposite wall 4 or 6 of the container A, which is convenient for hand-grip holes in the wall 4 or 6.

With a slight modification two mirror image corner protectors C become an edge protector E (FIG. 14) which extends the full length of an edge 16 on the object B and covers the corners 12 at both ends of that edge 16 as well. The modification essentially involves joining the panels 20 and 22 of the two corner protectors C into single extended panels 70 and 72, respectively (FIG. 14). The end panels 24 remain connected to the panel 72 at fold lines 26 in the outer facer sheet 30 of the honeycomb material, but of course abut along beveled surfaces. The panels 24 and panels 70 also abut along beveled surfaces. The beveled surfaces are of course derived by crushing the honeycomb cells 32 between the inner and outer facer sheets 28 and 30. The edge protector E (FIG. 14) also may be supplied without the end panels 24.

The side walls 4 of the container A need not be formed from corrugated paper, but may instead be some other material, even a polymer sheet material that is shrunk down around the object between two more solid end walls 6. This type of packaging is commonly used for household appliances.

This invention is intended to cover all changes and modifications of the example of the invention herein chosen for purposes of the disclosure which do not constitute departures from the spirit and scope of the invention.

What is claimed is:

1. A corner protector for positioning a generally rigid object having an exterior corner within a container that has an interior corner, with the positioning being such that exterior corner of the object is separated from the interior corner of the container, said corner protector comprising: first, second and third panels formed from honeycomb material, each panel having inner and outer facer sheets and honeycomb cells between the facer sheets, with the cells being generally perpendicular to the facer sheets, the first panel being attached to the second panel and being located at an angle with respect to the second panel, the third panel also being attached to the second panel and being located at an angle with respect to the second panel, the third panel also being located at an angle with respect to the first panel, the angles being such that the inner facer sheets converge to an interior corner, in the region where the first panel is attached to the second panel the honeycomb cells of the two panels being crushed and the inner facer sheets of the two panels being beveled toward the outer facer sheets of those panels to provide beveled surfaces that face each other and are adjacent to each other, in the region where the third panel is attached to the second panel the honeycomb cells of the two panels being crushed and the inner facer sheets being beveled toward the outer facer sheets of those panels to provide beveled surfaces that face each other and are adjacent to each other.

2. A corner protector according to claim 1 wherein the first, second and third panels are perpendicular to each other.

3. A corner protector according to claim 1 wherein the first and third panels are connected to the second panel along fold lines.

4. A corner protector according to claim 3 wherein the outer facer sheets of the first and third panels are attached to the outer facer sheet of the second panel.

5. A corner protector according to claim 4 wherein the first, second and third panels share a common outer facer sheet and are connected along fold lines that lie in the common outer facer sheet.

6. A corner protector according to claim 5 wherein the inner facer sheets of the panels have slit margins that separate the inner facer sheets of the panels and lei parallel to and generally along the fold lines, and the beveled surfaces of the inner facer sheets are along the slit margins.

7. A corner protector according to claim 6 wherein the beveled surfaces that lie along the fold lines between the first and second panels abut and the beveled surfaces that lie along the fold line between the third and second panels abut.

8. A corner protector according to claim 6 wherein the first and third panels have detached margins along their outer facer sheets and the detached margins lie adjacent and parallel to each other; wherein the honeycomb cells of the first and third panels are further crushed along the detached margins of the first and third panels such that the inner facer sheets have additional beveled surfaces along the detached margins; and wherein the additional beveled surfaces of the inner facer sheets for the first and third panels face each other and are adjacent to each other.

9. A corner protector according to claim 8 wherein the facing beveled surfaces in the inner facer sheets of the three panels abut.

10. A corner protector according to claim 9 wherein the beveled surfaces of the inner facer sheets for the first and third panels are bonded together.

11. A corner protector according to claim 1 and further comprising a fourth panel attached to the third panel; and wherein the honeycomb cells of the third and fourth panels are crushed in the region where those panels are connected such that the inner facer sheets of the two panels in that region are beveled downwardly toward the outer facer sheets, so as to provide beveled surfaces in the panels where the panels are joined to each other; wherein the beveled surfaces of the third and fourth panels abut; and wherein the fourth panel overlies the first panel.

12. A corner protector according to claim 11 wherein the fourth and first panels are attached in overlying relation.

13. A corner protector according to claim 1 wherein the facer sheets and honeycomb cells of the panels are made from paper.

14. A blank capable of being folded into a corner protector configured to fit over the corner of a rigid object, said blank comprising: first, second and third panels each formed from inner and outer facer sheets and honeycomb cells interposed between the facer sheets, with the axes of the cells being generally perpendicular to the sheets, the first and third panels being joined to the second panel at fold lines located at the outer facer sheets of the panels, but being detached at slit lines located at the inner facer sheets, with the slit lines being located parallel to and along the fold lines, the honeycomb cells of the first, second and third panels being crushed along the slit lines such that the inner facer sheets of the panels in the region of the slit lines are beveled downwardly toward the outer facer sheets.

15. A blank according to claim 14 wherein the first panel has a free edge which aligns with the slit line and fold line between the second and third panels, and the third panel is provided with a free edge which aligns with the slit line and fold line between the first and second panels; and wherein the honeycomb cells of the first and third panels are crushed in the region of the free edges for those panels such that the inner faces sheets of those panels form beveled surfaces along the free edges, with the bevel of those surfaces being downwardly toward the outer facer sheets.

16. A blank according to claim 14 and further comprising a fourth panel joined to the third panel and lying next to, but being detached from, the first panel.

17. A blank according to claim 14 wherein the first, second and third panels share a common outer facer sheet, and the fold lines are in the common outer facer sheet.

18. A blank according to claim 14 wherein the facer sheets and the honeycomb cells are made from paper.

19. In combination with a container having an inside corner and a generally rigid object located within the container and having an outside corner set inwardly from the inside corner of the container, a corner protector interposed between the inside corner of the container and the outside corner of the object for positioning the object within the container, said corner protector comprising: first, second and third panels arranged generally perpendicular to each other, each panel being formed from inner and outer facer sheets and honeycomb cells interposed between and attached to the facer sheets, with their axes being perpendicular to the facer sheets, the inner facer sheets being presented toward the object and the outer facer sheets being presented toward the container, each panel having edges located adjacent to edges of the other panels and having its honeycomb crushed in the region of such edges such that the inner facer sheets form beveled surfaces along those edges, the first panel along one of its edges being connected to the second panel along one of the edges of the second panel with the beveled surfaces of the two panels abutting along those edges, the third panel along one of its edges being connected to the second panel along another edge of the second panel, with the beveled surfaces of the panels of the second and third panels abutting along those edges, the remaining beveled surfaces of the first and third panels facing each other and being adjacent to each other.

20. The combination according to claim 19 wherein the outer facer sheets of the first, second and third panels of the corner protector are integral so that the panels share a common outer facer sheet; and wherein the panels are joined together at fold lines in the common outer facer sheet.

21. The combination according to claim 19 wherein the facer sheets and the honeycomb cells are made from paper.

22. A protector capable of fitting over the corner or edge of a rigid object to protect the object, said protector comprising: at least two panels disposed at an angle and being formed from a common sheet of honeycomb material which has parallel inner and outer facer sheets and honeycomb cells interposed between the sheets with their axes perpendicular to the sheets, the two panels being joined along their outer facer sheets where a fold lien exists between the panels, the honeycomb cells in the region of the fold line being crushed and the inner facer sheets being beveled downwardly toward the fold line at the crushed cells so as to form adjacent beveled surfaces on the panels, which surfaces accommodate the angular orientation of the panels with respect to each other.

23. A protector according to claim 22 wherein the panels abut along their beveled surfaces, but the inner facer sheet of the one panel is severed from the inner facer sheet of the other panel at the fold line.

24. A protector according to claim 23 wherein the panels are adhesively bonded together along their abutting beveled surfaces.

25. The protector of claim 22 in combination with a rigid object having an edge over which the protector is fitted with its inner facer sheets being against the object and a container in which the object lies, with the container having an edge into which the protector is fitted with its fold line along that edge.

26. A protector according to claim 22 wherein the facer sheets and the honeycomb cells of the honeycomb material are made from paper.

* * * * *